US009932142B2

(12) United States Patent
Kagawa et al.

(10) Patent No.: US 9,932,142 B2
(45) **Date of Patent: *Apr. 3, 2018**

(54) WRAPAROUND CASE

(71) Applicant: FUJIFILM CORPORATION, Minato-ku, Tokyo (JP)

(72) Inventors: Yusuke Kagawa, Kanagawa (JP); Nobuyuki Kimoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/215,611

(22) Filed: Jul. 21, 2016

(65) Prior Publication Data

US 2017/0081073 A1 Mar. 23, 2017

(30) Foreign Application Priority Data

Sep. 18, 2015 (JP) ..... 2015-185683

(51) Int. Cl.

| | |
|---|---|
| ***B65D 5/54*** | (2006.01) |
| ***B65D 5/02*** | (2006.01) |
| ***B65D 85/38*** | (2006.01) |
| ***B65D 5/42*** | (2006.01) |
| ***B65D 5/66*** | (2006.01) |

(52) U.S. Cl.

CPC ..... *B65D 5/5415* (2013.01); *B65D 5/6608* (2013.01)

(58) Field of Classification Search

CPC ... B65D 5/5415; B65D 5/6608; B65D 5/5425
USPC ..... 229/223, 237, 153, 242, 925, 232
See application file for complete search history.

(56) References Cited

U.S. PATENT DOCUMENTS

| | | | | |
|---|---|---|---|---|
| 2,737,095 | A | 3/1956 | Simjian | |
| 3,640,446 | A * | 2/1972 | Grieve | B65D 5/5405 229/223 |
| 4,643,315 | A * | 2/1987 | Hopwood | B65D 5/5435 229/193 |
| 4,915,235 | A | 4/1990 | Roosa | |
| 4,919,785 | A | 4/1990 | Willey et al. | |
| 5,078,273 | A * | 1/1992 | Kuchenbecker | B65D 5/542 229/207 |
| 5,167,606 | A | 12/1992 | Kuchenbecker | |
| 6,273,329 | B1 | 8/2001 | Zavatone | |
| 6,394,340 | B1 | 5/2002 | Anchor et al. | |

(Continued)

FOREIGN PATENT DOCUMENTS

| | | | |
|---|---|---|---|
| JP | 2002-12220 | A | 1/2002 |
| JP | 2004-59073 | A | 2/2004 |
| JP | 3176475 | U | 6/2012 |

*Primary Examiner* — Christopher Demeree

(74) *Attorney, Agent, or Firm* — SOLARIS Intellectual Property Group, PLLC

(57) ABSTRACT

A wraparound case comprises: a case main body including a top face panel and a bottom face panel that face each other, a front face panel and a back face panel that face each other, a pair of side face panels that face each other, and an insertion flap that extends out from the top face panel and overlaps with the front face panel; a hinge section that is formed between the top face panel and the back face panel; a slit that is formed along a ridgeline between the top face panel and each of the pair of side face panels; and tear sections that couple a front face panel side and a back face panel side of the top face panel with the pair of side face panels, and that are torn when the top face panel is opened.

8 Claims, 7 Drawing Sheets

(56) References Cited

U.S. PATENT DOCUMENTS

| | | | |
|---|---|---|---|
| 6,761,269 | B2 | 7/2004 | Hamming |
| 7,988,034 | B2 | 8/2011 | Pezzoli |
| 9,440,762 | B2 * | 9/2016 | Kagawa ..... B65D 5/0254 |
| 2006/0032900 | A1 | 2/2006 | Pratt et al. |
| 2011/0024487 | A1 | 2/2011 | Sant'Ana Caceres et al. |
| 2015/0197383 | A1 | 7/2015 | Wilson et al. |

* cited by examiner

WRAPAROUND CASE

CROSS-REFERENCE TO RELATED APPLICATION

This application claims priority under 35 USC 119 from Japanese Patent Application No. 2015-185683 filed Sep. 18, 2015, the disclosure of which is incorporated by reference herein in its entirety.

BACKGROUND

Technical Field

Preferred embodiments relate to a wraparound case.

Related Art

Conventional wraparound cases for allowing ease of opening and closing are known in which perforation is provided across an entire ridgeline of a top face lid, such that the top face lid can be easily re-closed after the top face lid has been opened (see, for example, Japanese Patent Application Laid-Open (JP-A) No. 2002-12220).

SUMMARY

However, when perforation is provided across the entire ridgeline of the top face lid, perforated tear marks are apparent, even when the top face lid has been re-sealed after the top face lid has been opened, such that there is a possibility of a negative effect on the appearance of the wraparound case.

In consideration of the above circumstances, an object of preferred embodiments is to provide a wraparound case in which perforation marks are less liable to be apparent, even when a top face panel is re-sealed after the top face panel has been opened.

A wraparound case of a first aspect of the disclosure includes: a case main body including a top face panel and a bottom face panel that face each other, a front face panel and a back face panel that face each other, a pair of side face panels that face each other, and an insertion flap that extends out from the top face panel and overlaps with the front face panel; a hinge section that is formed between the top face panel and the back face panel; a slit that is formed along a ridgeline between the top face panel and each of the pair of side face panels; and tear sections that couple a front face panel side and a back face panel side of the top face panel with the pair of side face panels, and that are torn when the top face panel is opened.

The first aspect of the disclosure enables the perforation marks to be less liable to be apparent, even when the top face panel is re-sealed after the top face panel has been opened.

DETAILED DESCRIPTION

Detailed explanation follows regarding an exemplary embodiment according to the present invention, based on the drawings.

Note that for ease of explanation, the arrow FR shown in each of the drawings indicates the front direction (front face side) of a wraparound case 10, and the opposite direction thereto is the rear direction (back face side). The arrow LH indicates the left direction of the wraparound case 10, and the left-right direction is the width direction of the wraparound case 10. The arrow UP indicates the upper direction of the wraparound case 10.

Figure 6:
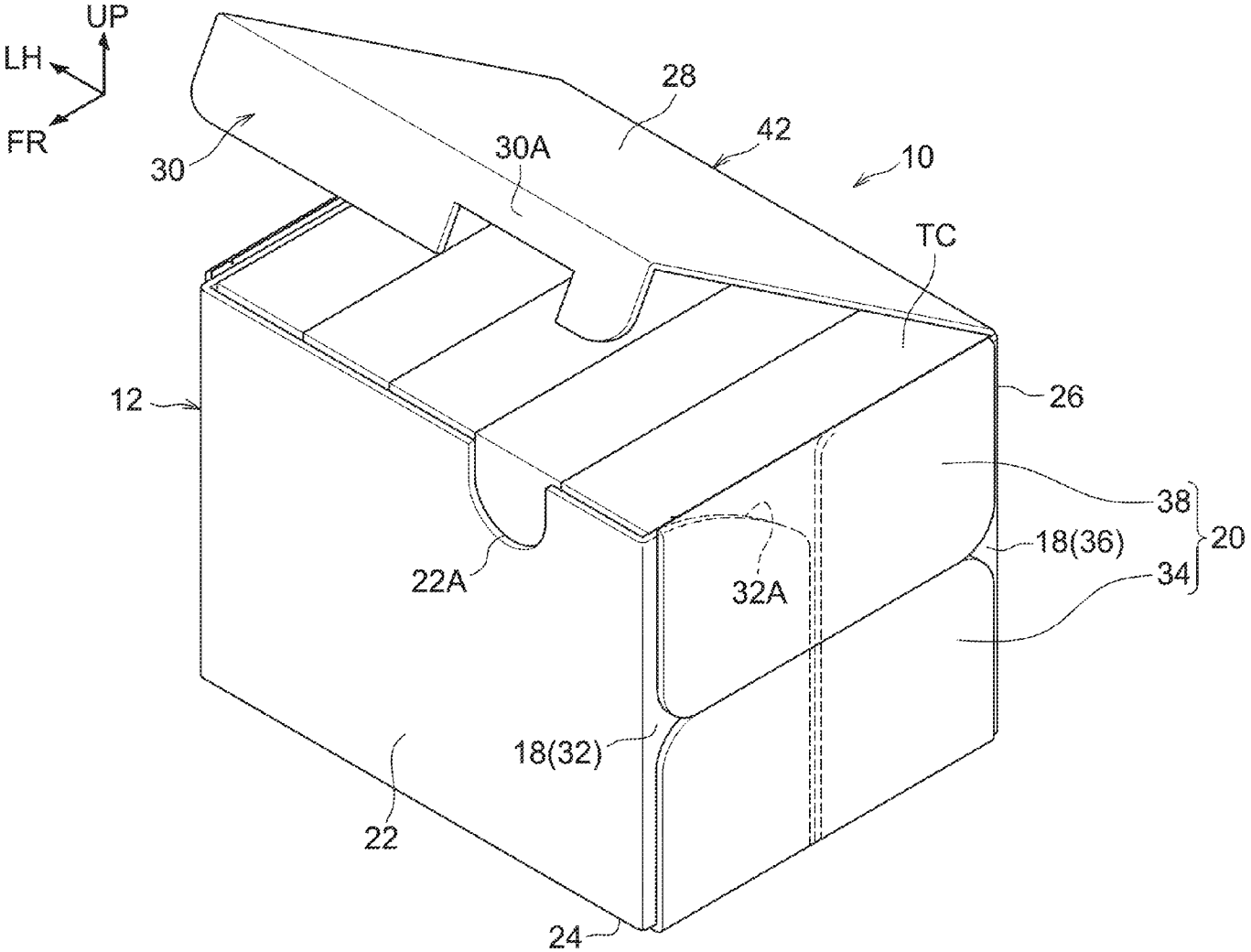
FIG. 6 is a perspective view illustrating a wraparound case according to the present exemplary embodiment in an opened state.

As illustrated in FIG. 6, in the present exemplary embodiment, recording tape cartridges TC are given as an example of products stored in the wraparound case 10; however, the products stored in the wraparound case 10 are not limited to the recording tape cartridges TC. As an example, the wraparound case 10 is formed using cardboard sheet made of paper or plastic with a uniform thickness.

Figure 1:
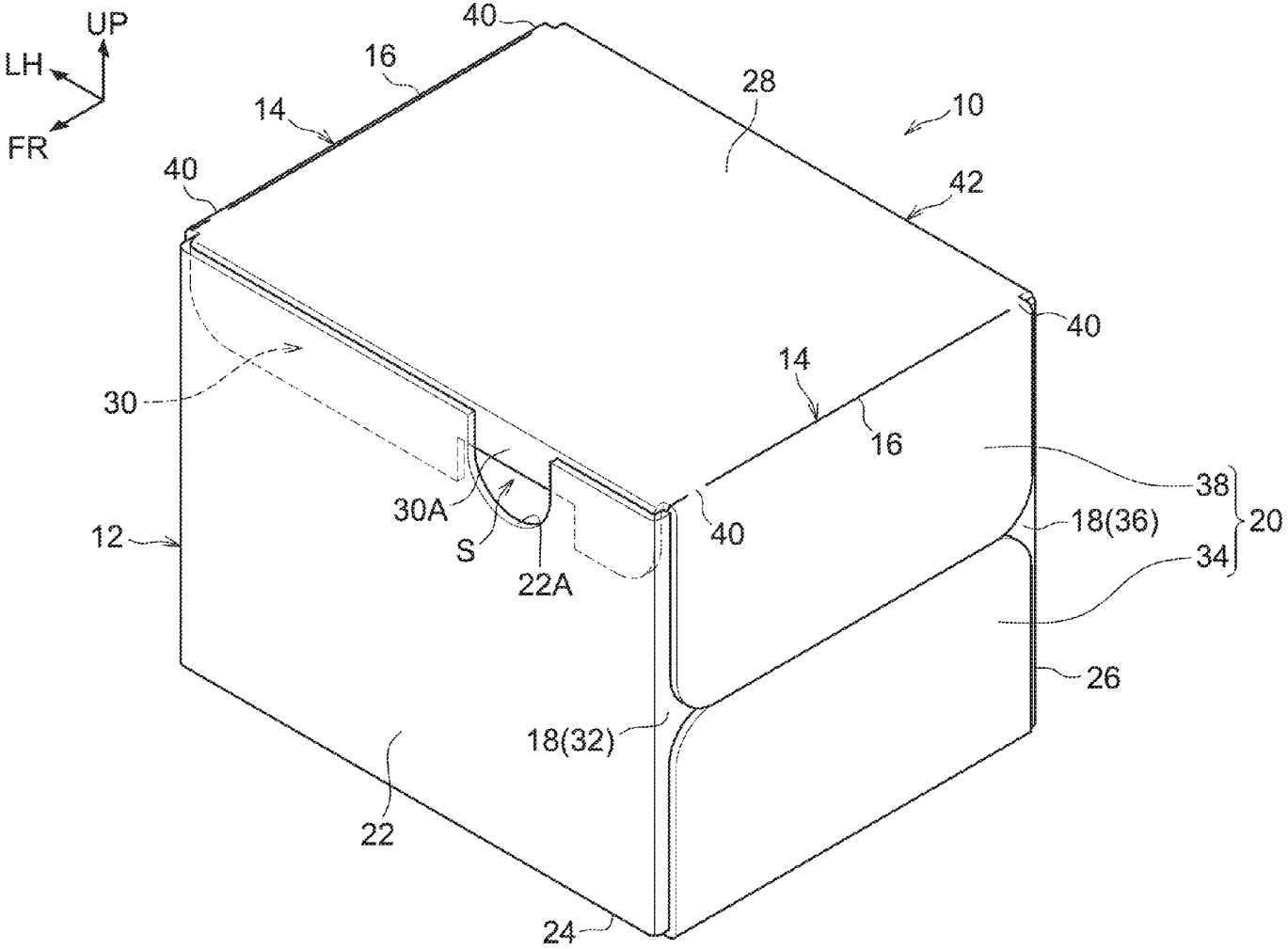
FIG. 1 is a perspective view of a wraparound case according to an exemplary embodiment, as viewed diagonally from above a front face side.

As illustrated in FIG. 1, the wraparound case 10 includes a case main body 12 that is substantially box shaped in a sealed state (an assembled state with the recording tape cartridges TC stored inside). Namely, as illustrated in FIG. 6, plural recording tape cartridges TC are stored inside the case main body 12.

The recording tape cartridges TC are each configured by a single reel wound with recording tape such as magnetic tape (not illustrated in the drawings) that is housed inside a flat rectangular box shaped case, and is mainly employed for data back-up of a computer or the like. Each recording tape cartridge TC is therefore sometimes stored and kept inside a flat rectangular box shaped plastic container that is slightly larger than its case.

In the present exemplary embodiment, plural recording tape cartridges TC, each in a state stored inside a plastic container, are stored inside the case main body 12 of the wraparound case 10, with an axial direction of their reels oriented along the left-right direction, that is a facing direction of side face panels 20, described later, and there is substantially no separation between the respective recording tape cartridges TC. Note that the case main body 12 of the wraparound case 10 is formed with a size capable of storing five recording tape cartridges TC.

Figure 2:
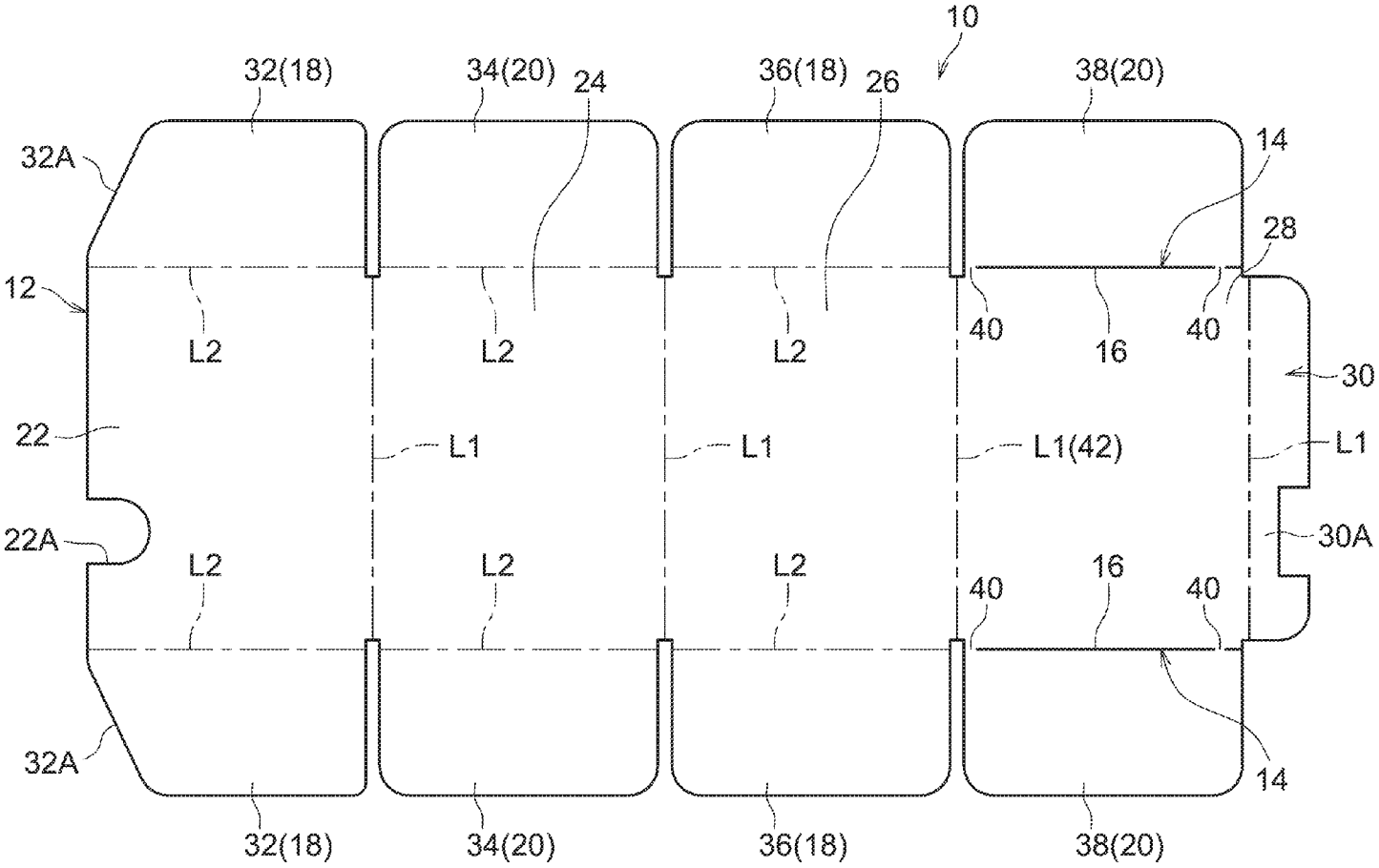
FIG. 2 is an opened-out view of a wraparound case according to the present exemplary embodiment.

As illustrated in FIGS. 1 and 2, the case main body 12 is formed including a front face panel 22, a bottom face panel 24, a back face panel 26, a top face panel 28, an insertion flap 30, and a pair of the side face panels 20. In the wraparound case 10 in the sealed state, the front face panel 22 and the back face panel 26 face each other in the front-rear direction, the top face panel 28 and the bottom face panel 24 face each other in the up-down direction, and the pair of side face panels 20 face each other in the width direction.

Thus, the front face panel 22 and the back face panel 26, the bottom face panel 24 and the top face panel 28, and the pair of side face panels 20 are respectively formed in substantially rectangular shapes with the same size as each other. A cutout portion 22A is formed in a portion that is an upper end portion of the front face panel 22 in the sealed state of the wraparound case 10. Note that the cutout portion 22A and the insertion flap 30 are explained in detail later.

As illustrated by single-dotted dashed lines in FIG. 2, fold lines L1 are respectively formed between the front face panel 22 and the bottom face panel 24, between the bottom face panel 24 and the back face panel 26, and between the back face panel 26 and the top face panel 28. Namely, the front face panel 22, the bottom face panel 24, the back face panel 26, and the top face panel 28 are coupled together with the fold lines L1 interposed therebetween. Note that the fold line L1 between the back face panel 26 and the top face panel 28 becomes a hinge section 42 when the top face panel 28 is opened and closed. The fold lines L1 are fold lines that are processed in order to facilitate folding. Similar applies to fold lines L2, described later.

As illustrated in FIG. 2, a pair of front side inner flaps 32 are respectively provided at either width direction side of the front face panel 22. The pair of front side inner flaps 32 are each formed in a substantially trapezoidal shape with a corner portion at a leading end side configured in a circular arc shape. Namely, a peripheral edge (upper end portion) of each front side inner flap 32 that is at the upper side in the sealed state of the wraparound case 10 configures a sloped portion 32A that slopes downward on progression from the front side (front face panel 22 side) toward the rear side (back face panel 26 side).

The fold lines L2 are respectively formed between the front face panel 22 and the pair of front side inner flaps 32, and the front side inner flaps 32 are folded along the fold lines L2. Front sides of inner panels 18 disposed at the width direction inner side of the side face panels 20 are respectively configured by the front side inner flaps 32.

A pair of rear side inner flaps 36 are respectively provided at both width direction sides of the back face panel 26. The pair of rear side inner flaps 36 are each formed in a substantially rectangular shape with both corner portions at a leading end side configured in a circular arc shape. The fold lines L2 are respectively formed between the back face panel 26 and the pair of rear side inner flaps 36, and the rear side inner flaps 36 are folded along the fold lines L2.

Rear sides of the inner panels 18 are respectively configured by the rear side inner flaps 36. Note that configuration may be such a gap is formed between rear ends of the front side inner flaps 32 folded along the fold lines L2 and front ends of the rear side inner flaps 36 folded along the fold lines L2 (see FIG. 6), or configuration may be such that the rear ends and the front ends abut each other.

A pair of lower side outer flaps 34 are respectively provided at either width direction side of the bottom face panel 24. The pair of lower side outer flaps 34 are each formed in a substantially rectangular shape with both corner portions at a leading end side configured in a circular arc shape. The fold lines L2 are respectively formed between the bottom face panel 24 and the pair of lower side outer flaps 34, and the lower side outer flaps 34 are folded along the fold lines L2. Lower sides of the side face panels 20 are respectively configured by the lower side outer flaps 34.

A pair of upper side outer flaps 38 are respectively provided at either width direction side of the top face panel 28. The pair of upper side outer flaps 38 are each formed in a substantially rectangular shape with both corner portions at a leading end side configured in a circular arc shape. A slit 16 and tear sections 40 are formed between the top face panel 28 and each of the pair of upper side outer flaps 38, and a ridgeline 14 is formed by folding each upper side outer flap 38 along the tear sections 40 (slit 16). Note that the slit 16 and the tear sections 40 are explained in detail later.

Upper sides of the side face panels 20 are respectively configured by the upper side outer flaps 38. Namely, the side face panels 20 are respectively configured by the lower side outer flaps 34 disposed at the lower sides and the upper side outer flaps 38 disposed at the upper sides, and are disposed at the width direction outer sides of the inner panels 18 respectively configured by the front side inner flaps 32 and the rear side inner flaps 36.

More specifically, as described later, the side face panels 20 are configured by folding all the fold lines L1, L2, and so on, then overlapping, from the width direction outsides, inner faces of the upper side outer flaps 38 and the lower side outer flaps 34 on outer faces of the front side inner flaps 32 and the rear side inner flaps 36, and joining these together using adhesive or the like.

Note that as illustrated in FIG. 1, in the wraparound case 10, configuration is such that the upper side outer flaps 38 and the lower side outer flaps 34 respectively abut each other in the up-down direction; however, configuration may be such that gaps are respectively formed between the upper side outer flaps 38 and the lower side outer flaps 34. Although only the side face panel 20 at the right side is illustrated in FIG. 1, the side face panel 20 at the left side is similarly configured.

Explanation follows regarding the cutout portion 22A formed at the front face panel 22, and the insertion flap 30 that extends out from the top face panel 28.

Figure 3:
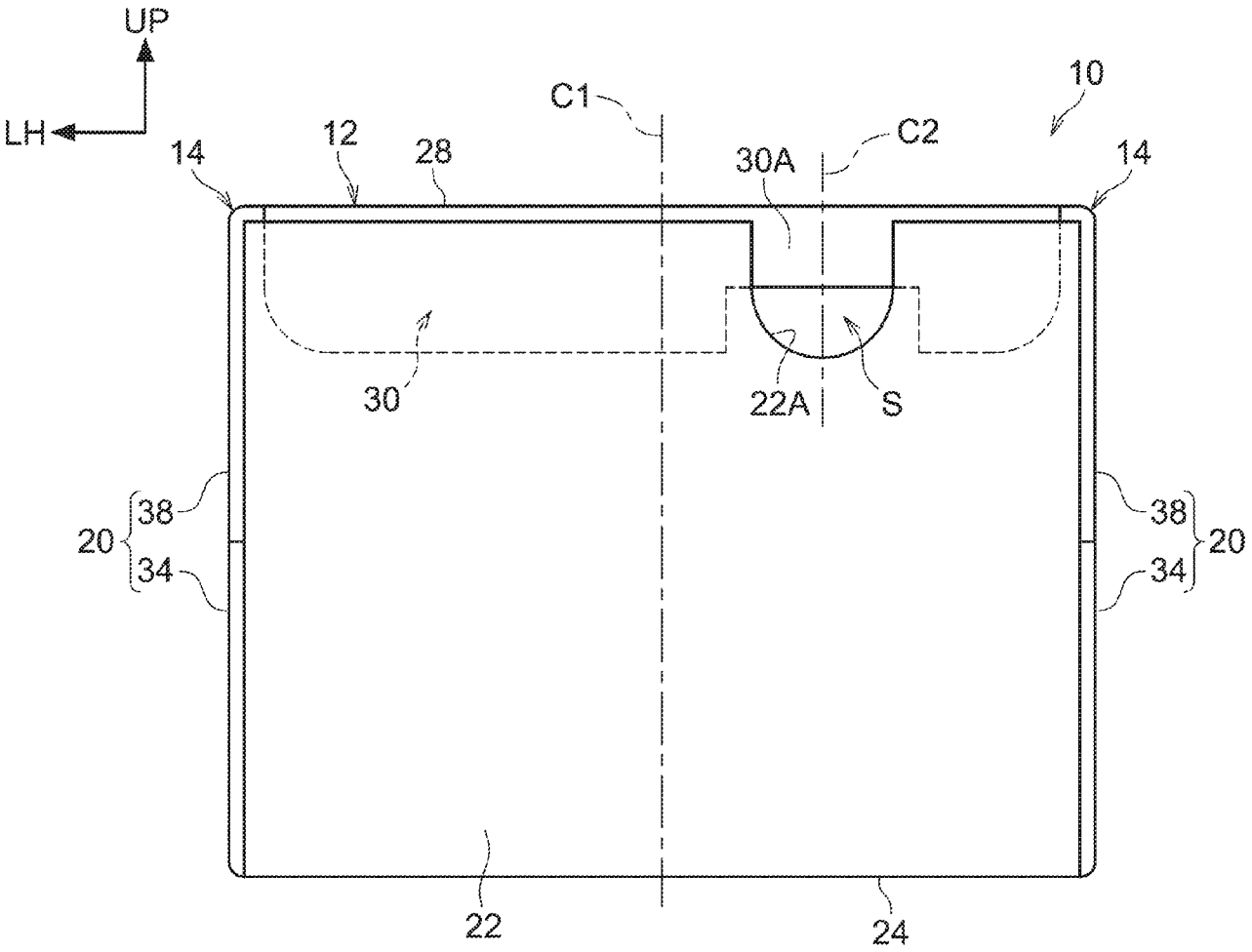
FIG. 3 is a face-on view of a wraparound case according to the present exemplary embodiment.

As illustrated in FIG. 3, in the sealed state of the wraparound case 10, the substantially U-shaped cutout portion 22A is formed at the upper end portion of the front face panel 22. The cutout portion 22A has an open side at an upper side thereof in face-on view. Namely, a lower end portion of the cutout portion 22A has a substantially circular arc shape. The cutout portion 22A is formed at a position offset toward a right side with respect to a center line C1 (center) in a width direction of the front face panel 22.

Note that "formed at an offset position" referred to herein is a concept including configurations in which a center in a width direction of the cutout portion 22A is formed at a position offset toward the right side (one end side) or a left side (another end side) with respect to the center in the width direction of the front face panel 22. Thus, as long as a center line C2 in the width direction of the cutout portion 22A is offset toward the right side or the left side with respect to the center line C1 in the width direction of the front face panel 22, the cutout portion 22A may be formed at a position straddling across the center line C1.

As illustrated in FIGS. 1 and 2, the insertion flap 30 is coupled to (extends out from) an opposite side of the top face panel 28 to the back face panel 26, and is, in an opened-out state, configured in a substantially rectangular shape that is long in the width direction, with both corner portions at a leading end side (extension direction side) configured in a circular arc shape. A fold line L1 is formed between the insertion flap 30 and the top face panel 28, and the insertion flap 30 is folded along the fold line L1.

Note that, when sealing the wraparound case 10, the insertion flap 30 is disposed inside an upper portion of the front face panel 22, and is overlapped with an inner face of the front face panel 22. Configuration is such that, after the wraparound case 10 has been opened, the wraparound case 10 may be re-sealed (repackaged) by inserting the insertion flap 30 inside the upper portion of the front face panel 22.

A length of the insertion flap 30 in the width direction is formed with substantially the same length as the top face panel 28, and a length of the insertion flap 30 in the up-down direction (extension length) in a sealed state is formed shorter than half a length of the front face panel 22 in the up-down direction. Note that there is no particular limitation to the length of the insertion flap 30 in the up-down direction, and any length is sufficient as long as the length is of an amount that the insertion flap 30 cannot easily be removed from inside the upper portion of the front face panel 22, and the length is of an amount that does not impair the ease of insertion of the insertion flap 30 into the upper portion of the front face panel 22 during re-sealing.

Part of a leading end portion (a lower end portion in the sealed state) of the insertion flap 30 is cut out in a substantially rectangular shape, thereby forming a short portion 30A. As illustrated in FIG. 3, in face-on view of the sealed state, the short portion 30A is formed at a portion that is exposed through the cutout portion 22A, and has a shorter length in the up-down direction than another portion (a general portion) of the insertion flap 30. A length of the short portion 30A in the width direction is slightly longer than the width of the cutout portion 22A.

The lower end portion of the cutout portion 22A formed in the front face panel 22 is positioned further toward a lower side than a lower end portion of the short portion 30A formed in the insertion flap 30. Thus, a spacing S, into which a finger can be inserted when opening the top face panel 28, is formed between the lower end portion of the short portion 30A and the lower end portion of the cutout portion 22A.

Next, explanation follows regarding the slit 16 and the tear sections 40 formed at the ridgeline 14 between the top face panel 28 and each upper side outer flap 38.

Figure 4:
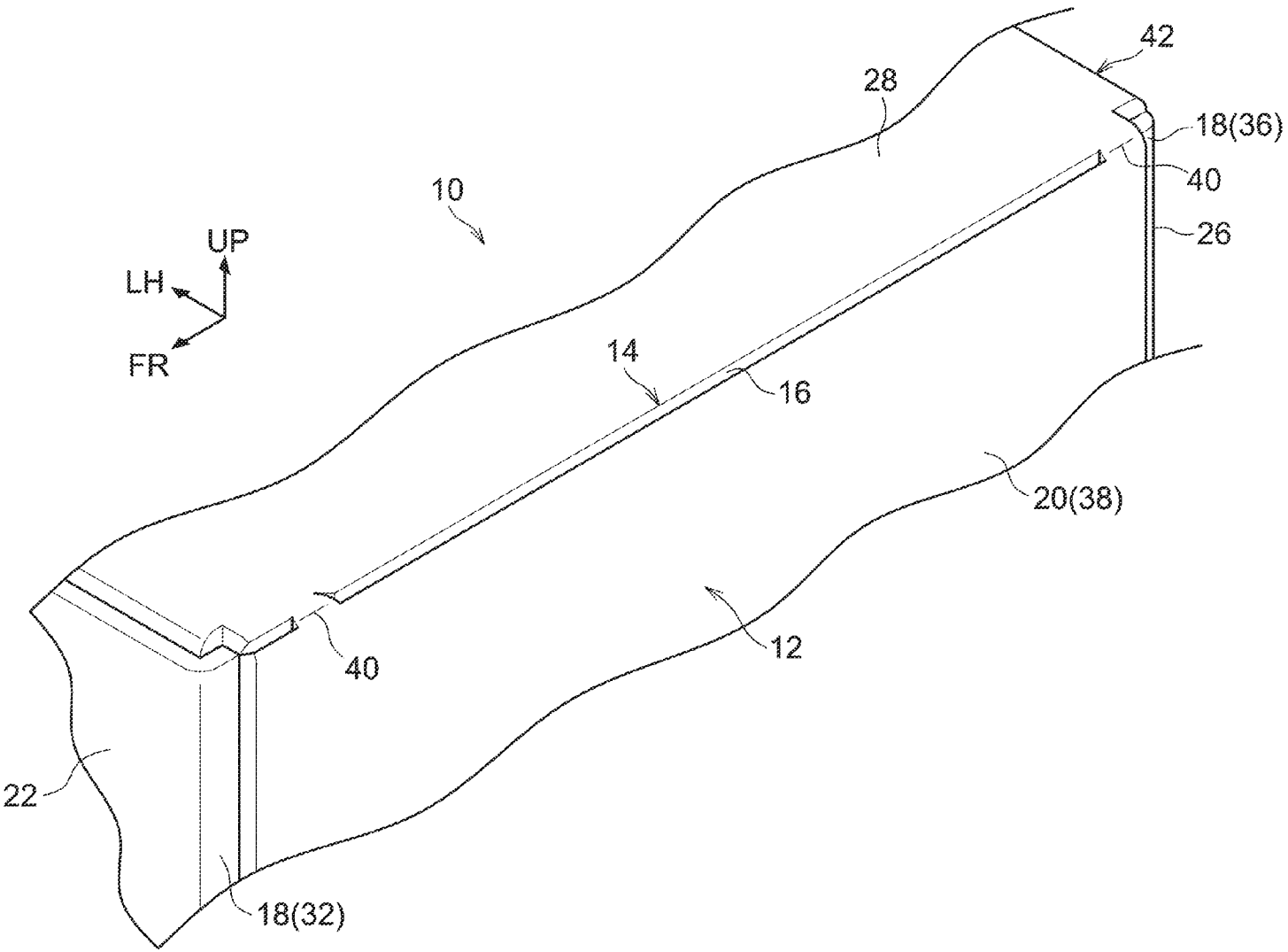
FIG. 4 is an enlarged perspective view illustrating a ridgeline between a top face panel and a side face panel of a wraparound case according to the present exemplary embodiment.

As illustrated in FIGS. 1, 2, and 4, the slit 16 is formed along the ridgeline 14 that is between the top face panel 28 and each upper side outer flap 38 of the side face panel 20, and divides the top face panel 28 and the upper side outer flap 38. The tear sections 40 are formed so as to respectively couple the front face panel 22 side and back face panel 26 side of the top face panel 28, with the front face panel 22 side and back face panel 26 side of the upper side outer flap 38, and link them together such that the top face panel 28 and each upper side outer flap 38 are not divided.

Namely, each upper side outer flap 38 is only coupled to the top face panel 28 by the respective tear sections 40 at one front and one rear locations. The respective tear sections 40 at one front and one rear locations are torn open when the top face panel 28 is opened. Note that there is no particular limitation to a length of each tear section 40 in the front-rear direction, and any length is sufficient as long as the length is of an amount enabling the sealed state to be maintained when the wraparound case 10 is sealed, and enabling easy tearing when the wraparound case 10 is opened.

Explanation follows regarding operation of the wraparound case 10 configured as described above.

When accommodating plural (five, for example) recording tape cartridges TC in a state stored in plastic containers inside the wraparound case 10, each of the recording tape cartridges TC is placed on an inner face of the bottom face panel 24. Note that the recording tape cartridges TC are arrayed with the axial direction of their reels oriented along the left-right direction when this is performed.

In a state in which all the fold lines L1, L2 and the tear sections 40 have been folded, and the insertion flap 30 has been disposed inside the upper portion of the front face panel 22, the inner faces of the upper side outer flaps 38 and the lower side outer flaps 34 respectively configuring the side face panels 20 are joined by adhesive or the like to the outer faces of the front side inner flaps 32 and the rear side inner flaps 36 respectively configuring the inner panels 18. Thus, the wraparound case 10 is assembled with the plural recording tape cartridges TC accommodated inside.

When the wraparound case 10 in the sealed state is opened, an operator hooks a finger on the lower end portion of the short portion 30A of the insertion flap 30 and lifts up the top face panel 28 to tear open the tear section 40. As illustrated in FIG. 3, the spacing S is formed between the lower end portion of the short portion 30A and the lower end portion of the cutout portion 22A, thereby enabling the operator to easily lift up the insertion flap 30 by inserting one's finger into the spacing S when this is performed.

Namely, the ease of opening can be improved compared to configurations in which the spacing S is not formed. As illustrated in FIG. 4, the tear sections 40 that couple the top face panel 28 and the upper side outer flaps 38 together are only formed at the locations of the front face panel 22 side and the back face panel 26 side of each of the left and right ridgelines 14. Thus, the respective tear sections 40 are easily torn open when the operator has hooked the finger onto the lower end portion of the short portion 30A of the insertion flap 30 and lifted up the top face panel 28.

To explain in detail, as illustrated in FIG. 3, the cutout portion 22A formed in the front face panel 22 is located at a position offset toward the right side with respect to the center line C1 (center) of the front face panel 22, such that more load acts on the tear section 40 at the front right side when the top face panel 28 has been lifted up. Thus, the tear section 40 at the front right side is torn open earlier than the other tear sections 40.

Figure 5:
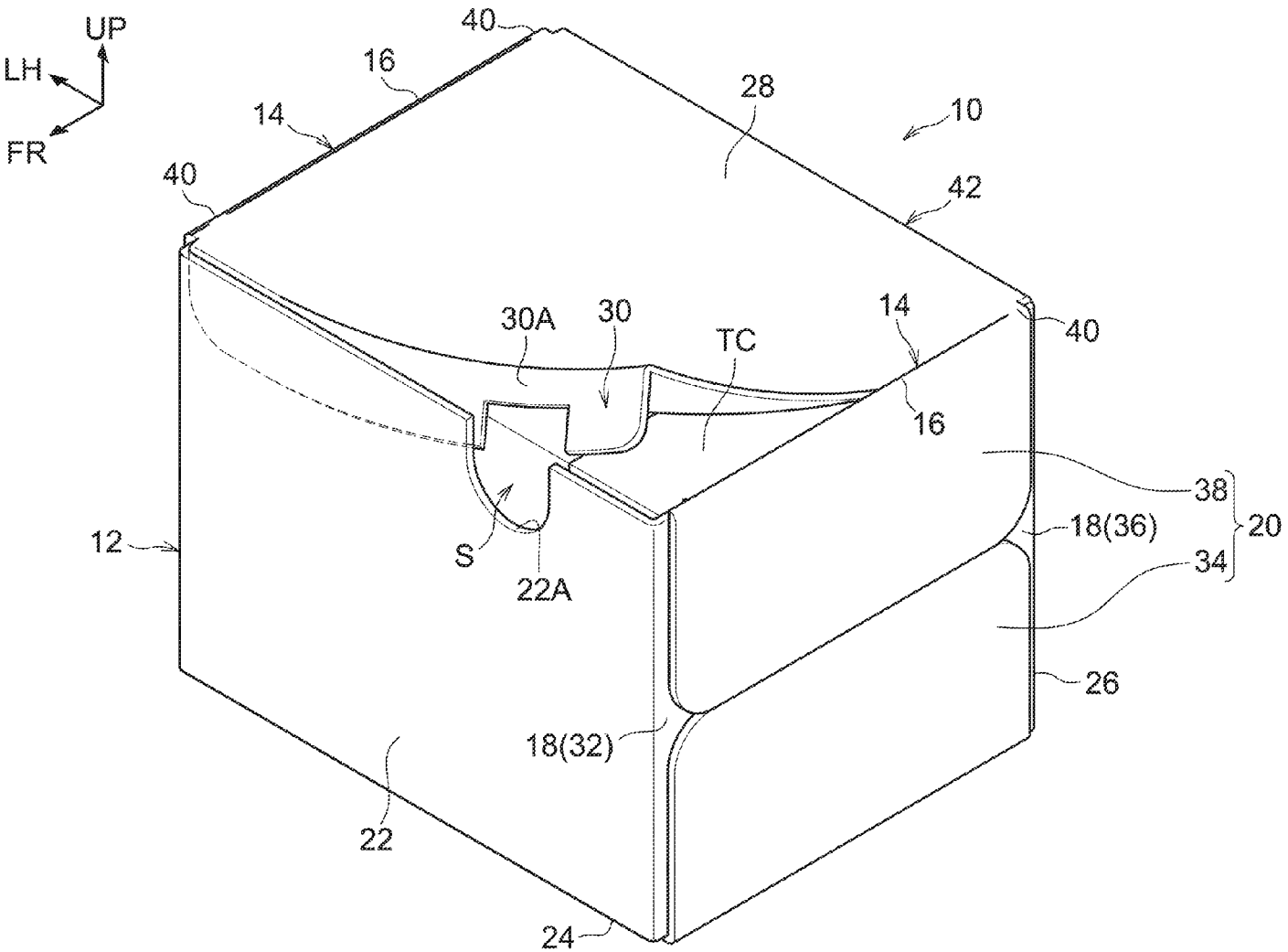
FIG. 5 is a perspective view illustrating a wraparound case according to the present exemplary embodiment in an opening state.

When the top face panel 28 is lifted up following this, as illustrated in FIG. 5, the front right side of the case main body 12 starts to open, and load then acts on the tear section 40 at the front left side and the tear section 40 at the rear right side. Namely, the tear section 40 at the front left side and the tear section 40 at the rear right side are torn open. When the top face panel 28 is lifted up further, load acts on the tear section 40 at the rear left side, and the tear section 40 at the rear left side is also torn open.

The wraparound case 10 is opened in the above manner. In the present exemplary embodiment, load is concentrated to tear open the tear section 40 at the front right side (one side), then load is concentrated to tear open the tear sections 40 at the front left side and the rear right side (other sides), thereby enabling each tear section 40 to be torn open under a small load.

In configurations in which the cutout portion 22A is formed at a position at the center line C1 (center) of the front face panel 22, for example, substantially equivalent loads are distributed to the tear sections 40 at both the front left and front right sides when a finger is hooked onto the lower end portion of the short portion 30A and the top face panel 28 is lifted up. Thus, sufficient load to tear open the tear sections 40 at both the front left and front right sides at the same time is required when opening the top face panel 28.

In contrast thereto, in the wraparound case 10 according to the present exemplary embodiment, load is first concentrated on the tear section 40 at the front right side, thereby enabling the tear section 40 to be torn open under a smaller load than in cases in which the tear sections 40 at both the front left and front right sides are torn open at the same time. This enables the load required to open the top face panel 28 to be reduced, and enables the ease of opening the wraparound case 10 to be improved.

As illustrated in FIG. 6, the wraparound case 10 (top face panel 28) is opened by tearing open the respective tear sections 40 in this manner. In the wraparound case 10, the respective tear sections 40 are only formed at one front and one rear locations of each ridgeline 14. This enables tear marks to be less liable to be apparent, and enables a negative effect on the appearance of the wraparound case 10 to be suppressed, compared to configurations in which plural tear sections in perforated form are formed on each ridgeline 14.

As illustrated in FIG. 6, the upper end portion of each front side inner flap 32 is configured as the sloped portion 32A that slopes downward on progression from the front face panel 22 side toward the back face panel 26 side. Thus, when removing a recording tape cartridge TC from inside the case main body 12 in an opened state, a finger can be inserted between the recording tape cartridge TC at a left end or a right end and the respective upper side outer flap 38 to remove the recording tape cartridge TC.

Namely, even in configurations in which the recording tape cartridges TC are stored inside the case main body 12 with almost no gap therebetween, as in the wraparound case 10, the recording tape cartridges TC can be easily removed from inside the case main body 12. Note that configuration may be such that the sloped portion 32A is only formed to the upper end portion of the front side inner flap 32 at the right side, or only formed to the upper end portion of the front side inner flap 32 at the left side.

A sloped portion (not illustrated in the drawings) that slopes downward on progression from the back face panel 26 side toward the front face panel 22 side may be formed at an upper end portion of each rear side inner flap 36; however, the wraparound case 10 is configured to be opened from the front side. Namely, since the rear side of the top face panel 28 becomes the hinge section 42 when the top face panel is lifted up, it is preferable to form the sloped portion 32A at the upper end portion of each front side inner flap 32.

Recording tape cartridges TC that have been removed from inside the case main body 12 are sometimes stored inside the case main body 12 again after labels (not illustrated in the drawings), for example, have been stuck on. Thus, the wraparound case 10 according to the present exemplary embodiment is a configuration that enables re-sealing (repackaging).

Namely, the wraparound case 10 can be re-sealed by inserting the insertion flap 30 inside the upper portion of the front face panel 22. Note that tear marks that have been made by having torn the tear sections 40 are less liable to be apparent when the re-sealing is performed, thereby enabling a negative effect on the appearance of the wraparound case 10 to be suppressed.

In the wraparound case 10, as illustrated in FIG. 3, the lower end portion of the cutout portion 22A is formed in a substantially circular arc shape. This enables external exposure of the interior (the recording tape cartridges TC) of the case main body 12 to be suppressed while securing the spacing S for inserting a finger, compared to configurations in which the cutout portion 22A is cut out in a substantially rectangular shape, for example.

The wraparound case 10 according to the present exemplary embodiment has been explained above based on the drawings; however, the wraparound case 10 is not limited to that illustrated, and various layout modifications may be applied as appropriate within a range not departing from the scope of the present invention recited in the claims. For example, the insertion flap 30 is inserted inside the upper portion of the front face panel 22 in the sealed state; however, there is no limitation thereto, and the insertion flap 30 may be joined to an outer face of the upper portion of the front face panel 22 using an adhesive or the like that allows easy peeling.

In such cases, after the insertion flap 30 has been peeled off the outer face of the upper portion of the front face panel 22, the wraparound case 10 can be opened similarly to as previously described by gripping a right end portion or a left end portion of the insertion flap 30 and lifting up the top face panel 28. Note that in such cases, there is an advantage in that the short portion 30A does not need to be formed in the insertion flap 30. Moreover, re-sealing (repackaging) can be performed after opening by inserting the insertion flap 30 inside the upper portion of the front face panel 22.

Moreover, in cases in which the length of the cutout portion 22A in the up-down direction is longer than the length of the insertion flap 30 in the up-down direction, the short portion 30A does not need to be formed in the insertion flap 30. In the wraparound case 10, the cutout portion 22A is formed at a position offset toward the right side with respect to the center line C1 in the width direction of the front face panel 22; however, there is no limitation thereto, and the cutout portion 22A may be formed at a position offset toward the left side with respect to the center line C1.

Cutout portions 22A may be respectively formed both at positions offset toward the right side and the left side with respect to the center line C1 in the width direction of the front face panel 22, short portions 30A of the insertion flap 30 are also formed at both left and right sides corresponding to the respective cutout portions 22A. As long as the tear sections 40 are easily torn, the center line C2 in the width direction of the cutout portion 22A may be formed at a position aligned with the center line C1 in the width direction of the front face panel 22.

Figure 7:
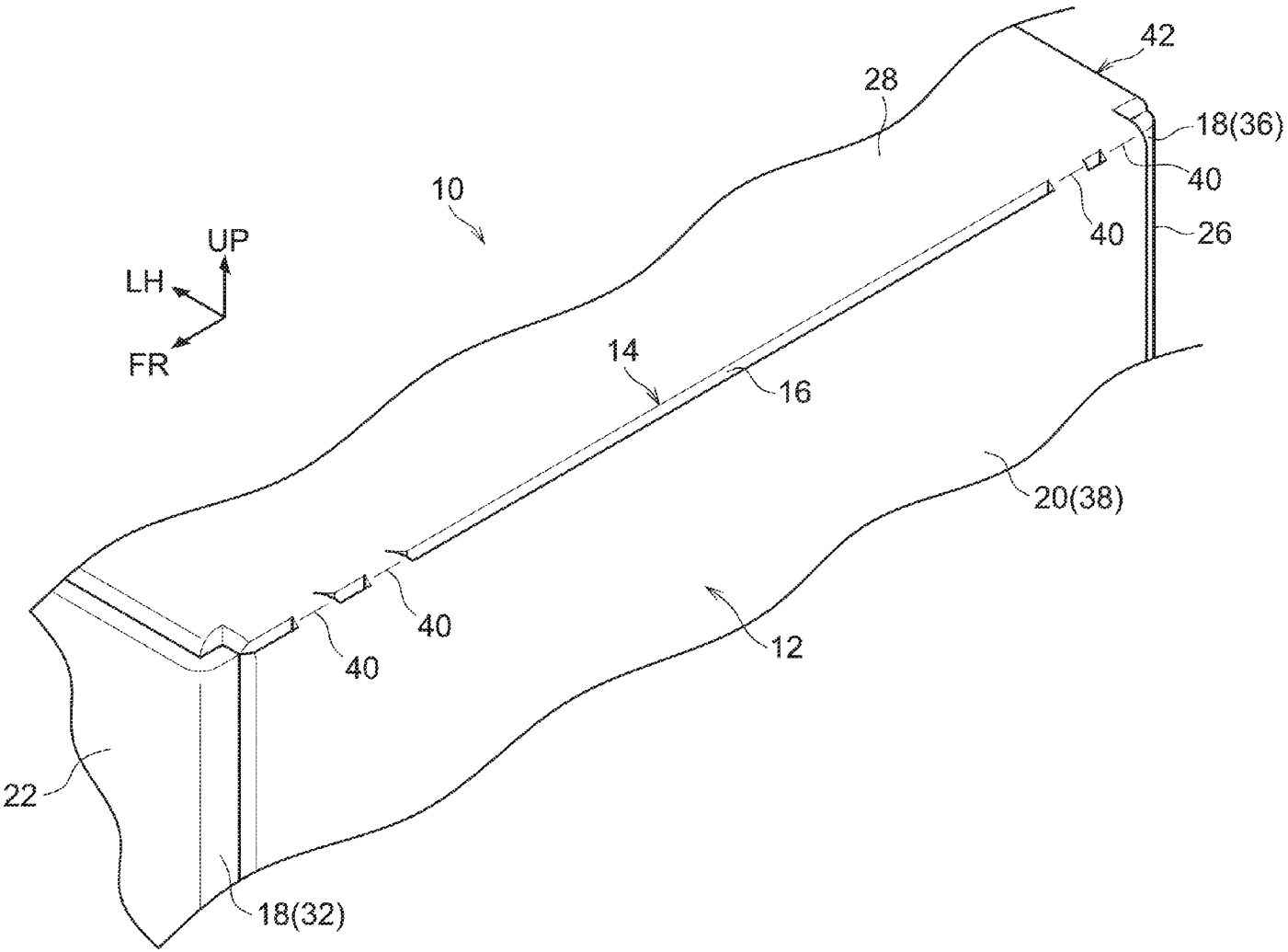
FIG. 7 is an enlarged perspective view illustrating a modified example of a ridgeline between a top face panel and a side face panel of a wraparound case according to the present exemplary embodiment.

In the wraparound case 10 according to the present exemplary embodiment, one tear section 40 is respectively formed at the front and rear of each ridgeline 14; however, there is no limitation thereto. For example, as illustrated in FIG. 7, configuration may be such that two tear sections 40 are provided at the front face panel 22 side of the top face panel 28 and each upper side outer flap 38 in the side face panel 20, and two tear sections 40 are provided at the back face panel 26 side of the top face panel 28 and each upper side outer flap 38.

Although not illustrated in the drawings, configuration may be such that three tear sections 40 are provided at the front face panel 22 side of the top face panel 28 and each upper side outer flap 38, and three tear sections 40 are provided at the back face panel 26 side of the top face panel 28 and each upper side outer flap 38. The number of tear sections 40 may differ at the front and rear of each ridgeline 14, and may differ between the left and right ridgelines 14.

For example, two tear sections 40 may be formed at the front side and one tear section 40 at the rear side of each left and right ridgeline 14. Alternatively, two tear sections 40 may be formed at the front side and two tear sections 40 at the rear side of the ridgeline 14 at the right side, and one tear section 40 may be formed at the front side and one tear section 40 at the rear side of the ridgeline 14 at the left side. In any case, it is sufficient for the tear sections 40 to be provided in small groups at both front and rear end portions of each ridgeline 14, and for the slit 16 to be formed with a length that largely divides a front-rear direction center portion of the respective ridgeline 14 in the front-rear direction, for example, a length of the slit 16 is 80% of the length of the ridgeline 14, or greater.

The case main body 12 of the wraparound case 10 according to the present exemplary embodiment is formed with a size capable of storing five recording tape cartridges TC; however, the size of the case main body 12 is not limited thereto. For example, the case main body 12 may be formed with a size capable of storing six recording tape cartridges TC or more, or may be formed with a sized capable of storing four recording tape cartridges TC or fewer.

What is claimed is:

1. A wraparound case comprising:

a case main body including a top face panel and a bottom face panel that face each other, a front face panel and a back face panel that face each other, a pair of side face panels that face each other, and an insertion flap that extends out from the top face panel and overlaps with the front face panel;

a hinge section that is formed between the top face panel and the back face panel;

a slit that is formed along a ridgeline between the top face panel and each of the pair of side face panels; and tear sections that couple a front face panel side and a back face panel side of the top face panel with the pair of side face panels, and that are torn when the top face panel is opened, wherein a cutout portion is formed at an upper end portion of the front face panel, at a position offset toward one end side or another end side with respect to a center in a facing direction of the side face panels.

2. The wraparound case of claim 1, wherein a plurality of the tear sections are respectively formed at the front face panel side and the back face panel side between the top face panel and the pair of side face panels.

3. The wraparound case of claim 1, wherein the insertion flap overlaps with an inner face side of the front face panel.

4. The wraparound case of claim 3, wherein the cutout portion exposes part of the insertion flap.

5. The wraparound case of claim 4, wherein:

a part of the insertion flap that is exposed through the cutout portion is a short portion formed with a shorter extension length from the top face panel than another portion of the insertion flap; and a spacing is formed between a lower end of the short portion and a lower end of the cutout portion.

6. The wraparound case of claim 1, wherein the cutout portion is formed in a circular arc shape.

7. The wraparound case of claim 1, wherein:

inner panels are respectively disposed at facing direction inner sides of the pair of side face panels; and an upper end portion at a front face panel side of at least one of the inner panels is a sloped portion that slopes downward on progression from the front face panel side toward a back face panel side.

8. The wraparound case of claim 1, wherein a length of the slit is 80% of a length of the ridgeline, or greater.

* * * * *